United States Patent [19]

Miller et al.

[11] Patent Number: 4,675,706

[45] Date of Patent: Jun. 23, 1987

[54] PRESSURE-SENSITIVE RECORD MATERIAL

[75] Inventors: Robert E. Miller; Robert W. Brown, both of Appleton, Wis.

[73] Assignee: Appleton Papers Inc., Appleton, Wis.

[21] Appl. No.: 837,109

[22] Filed: Mar. 7, 1986

[51] Int. Cl.[4] ..... B41M 5/22

[52] U.S. Cl. ..... 503/210; 503/207; 503/212; 503/213; 503/226; 427/150; 427/151

[58] Field of Search ..... 346/213, 215, 226, 200, 346/207, 210–212, 216–221, 225; 427/150–152

[56] References Cited

U.S. PATENT DOCUMENTS 4,335,013 6/1982 Allart et al. ..... 346/213

OTHER PUBLICATIONS

Jablonski et al., "Solvent-assisted Pressure-effected Image Transfer", IBM Tech. Disc. Bul., vol. 14, #10, Mar. 1972.

*Primary Examiner*—Bruce H. Hess

*Attorney, Agent, or Firm*—E. Frank McKinney; Paul S. Phillips, Jr.

[57] ABSTRACT

Disclosed is a pressure-sensitive record unit which comprises a top sheet having coated on the underside thereof solid color former material and a bottom sheet having coated on the upper side thereof a coating comprising solid color developer material and microcapsules containing a liquid solvent for the color former. Such a record unit makes possible the unexpectedly efficient utilization of the color former material. It furthermore permits the printing application of some of the components, resulting in even more efficient utilization of color former material and elimination of undesirable side effects of printed record units taught in the prior art.

13 Claims, No Drawings

PRESSURE-SENSITIVE RECORD MATERIAL

This invention pertains, generally, to pressure-sensitive recording media. Such recording media include colorless but colorable components separated to prevent coloration until the components are somehow brought together. More particularly, this invention relates to a novel pressure-sensitive recording system, wherein mark-forming components are brought, upon selective release of minute droplets of an isolated solvent for at least one of said components, into mark-forming contact by the released portion of said solvent.

In the past, there have been provided pressure-sensitive mark-forming systems which comprised various arrangements of the mark-forming components and minute droplets of isolated solvent which, upon pressure release, brought the mark-forming components into reactive contact. Many of these configurations are depicted in U.S. Pat. No. 3,672,935, which is hereby incorporated by reference. The most widely used configuation commercially is depicted in FIG. 2, view III, of said patent. In such a configuration the underside of the top sheet (the coated back or CB sheet) of a two-ply system is coated with a microcapsule layer wherein the microcapsules contain a solution of chromogenic material, commonly called the color former. The top side of the bottom sheet (the coated front or CF sheet) is coated with a layer comprising developer material. To the uncoated side of the CF sheet can also be applied microcapsules containing a solution of color formers resulting in a pressure-sensitive sheet which is coated on both the front and back sides (hereinafter referred to as a CFB sheet). When said plies are superimposed, one on the other, in such a manner that the microcapsules of one ply are in proximity with the color developers of the second ply, the application of pressure, as by typewriter, sufficient to rupture the microcapsules, releases the solution of color former and transfers color former solution to the CF sheet resulting in image formation through reaction of the color former solution with the color developer.

Japanese Publication No. 60-008960 discloses a two-sheet pressure-sensitive reproduction system wherein the underside of the top sheet is coated with a layer containing developer material dissolved or dispersed in waxes and the top side of the bottom sheet is coated with a layer containing microcapsules and an inert pigment wherein the microcapsules contain a solution of color former. The coating on the underside of the top sheet may be spot printed.

Japanese Publication No. 61-001317 discloses a two-sheet pressure-sensitive reproduction paper wherein the underside of the top sheet is coated with a layer containing developer material and coloring pigment dissolved or dispersed in waxes and the top side of the bottom sheet is coated with a layer containing microcapsules wherein the microcapsules contain a solution of color former.

U.S. Pat. No. 4,298,651 discloses a two-sheet pressure-sensitive copying element wherein the underside of the top sheet is coated with a microcapsule layer wherein the microcapsules contain a solvent and the top side of the bottom sheet is coated with a layer containing particles of color former and particles of developer material.

U.S. Pat. No. 3,839,070 discloses a two-sheet pressure-sensitive recording system wherein the underside of the top sheet is coated with a layer containing developer material and the top side of the bottom sheet is coated with a microcapsule layer wherein the microcapsules contain a solution of color former. When these sheets are superimposed and localized pressure applied to the uncoated side of the top sheet, the microcapsules are ruptured producing simultaneously a right-reading image on the bottom sheet surface and a mirror image on the coated surface of the top sheet.

The arrangement of the components as disclosed in U.S. Pat. No. 3,839,070 provides a useful configuration for record sets wherein a translucent sheet overlies an opaque sheet. However, in the overwhelming majority of pressure-sensitive mark-forming systems, which utilize only opaque sheets, the production of both right-reading and mirror images is a decided disadvantage for several reasons. One of the principal reasons for the undesirability of producing both types of images in a pressure-sensitive system employing opaque sheets is economic. The mark-forming components are expensive, particularly the color former, and their use in producing a mirror image on the backside of the opaque top sheet is a needless waste of these materials. Furthermore, such an image is useless because it can only be viewed in its backwards, mirror image form.

Very often, the backside of the top sheet in pressure-sensitive mark-forming systems has indicia produced by the application of colored inks by conventional printing techniques. If the mark-forming system produces a mirror image, as well as a right reading image, the characters of the mirror image would partially obliterate the printed indicia, rendering it partially or totally illegible.

In the production of the plies of a pressure-sensitive form, it is frequently advantageous or desirable to apply one of the components of the mark-forming components to selective areas of the form in a spot printing fashion. This is done primarily for two purposes. First, forms can be made which are pressure-sensitive only in areas where an image is required and there is no pressure sensitivity in other areas. Second, there can be a substantial savings in cost of material, particularly if the color former (the more expensive component) can be applied only where needed.

When a pressure-sensitive form of the configuration shown in FIG. 2, view III, of U.S. Pat. No. 3,672,935, is produced, at least in part, by a spot printing method, there is a strong desire to spot print the microcapsules containing the color former solution because they are, by far, the more expensive component. The microcapsules for such a configuration need to be applied at a coat weight of about 3.7 to 4.4 grams per square meter (gsm) and when they are applied by a non-heatset offset method, the most widely used printing method, an amount of vehicle equivalent to about 7.4 to 8.8 gsm is required. This amount of vehicle transparentizes the sheet and causes setoff and blocking. Setoff is an undesirable transfer of ink from the printed sheet to the back of the sheet adjacent to it. Blocking is an undesired adhesion between printed sheets.

Applicants have found that these and other problems can be overcome by providing a pressure-sensitive record unit comprising a first support having bound on the surface thereof a coating comprising solid color former material and a second support having bound on the surface thereof, in contiguous juxtaposition with the coating of the first support, a coating comprising solid color developer material and microcapsules containing a liquid solvent for the color former.

In the context of the present invention, solid color former material includes solid particles of color former alone or solid particles comprising color former dispersed or dissolved in a resin.

In such a pressure-sensitive record unit, the application of pressure, as by typewriter, sufficient to rupture the microcapsules, releases the solvent which dissolves the color former coated on the first support and brings it into reactive contact with the color developer coated on the second support, producing an image in the pattern of the applied pressure on the surface of the second support. The surprising feature of the present invention is that the image forms only on the surface of the second support, even when a color developer material soluble in the liquid solvent is employed. Furthermore, the configuration of the invention can provide a more efficient utilization of the color former.

The configuration of the present invention permits, as one possible manufacturing method, the production of the coating of the second support over the entire area of the support and the spot printing of the color former coating of the first support. Such an arrangement permits the application of the most expensive component, the color former, only in the areas where it is needed. Also, since drastically reduced coat weights of color former are required (as compared to the coat weights required for microcapsules containing a color former solution), problems of transparentitizing, setoff and blocking are eliminated because of the corresponding drastic reduction in quantity or elimination of vehicle.

Other objects and advantages of the invention will become more apparent from the following detailed description.

The coating of the first support comprises a chromogenic material bound on the surface. The coating can be applied by any appropriate means including printing presses. Particularly useful is the offset printing method. The coating can be applied over the entire surface of the support or can be applied only where required in a spot printing method.

Eligible color formers for use in the present invention include, but are not limited to, Crystal Violet Lactone [3,3-bis(4-dimethylaminophenyl)-6-dimethylaminophthalide (U.S. Pat. No. Re. 23,024)]; phenyl-, indol-, pyrrol-, and carbazol-substituted phthalides (for example, in U.S. Pat. Nos. 3,491,111; 3,491,112; 3,491,116; 3,509,174); nitro-, amino-, amido-, sulfon amido-, aminobenzylidene-, halo-, anilino-substituted fluorans (for example, in U.S. Pat. Nos. 3,624,107; 3,627,787; 3,641,011; 3,642,828; 3,681,390); spirodipyrans (U.S. Pat. No. 3,971,808); and pyridine and pyrazine compounds (for example, in U.S. Pat. Nos. 3,775,424 and 3,853,869). Other specifically eligible chromogenic compounds, not limiting the invention in any way, are; 3-diethylamino-6-methyl-7-anilinofluoran (U.S. Pat. No. 3,681,390); 3-diethylamino-6-methyl-7-(2',4'-dimethylanilino)-fluoran; 7-(1-ethyl-2-methylindol-3-yl)-7-(4-diethylamino-2-ethoxyphenyl)-5,7-dihydrofuro[3,4-b]pyridin-5-one (U.S. Pat. No. 4,246,318); 3-diethylamino-7-(2-chloroanilino)fluoran (U.S. Pat. No. 3,920,510); 3-(N-methylcyclohexylamino)-6-methyl-7-anilinofluoran (U.S. Pat. No. 3,959,571); 7-(1-octyl-2-methylindol-3-yl)-7-(4-diethylamino-2-ethoxyphenyl)-5,7-dihydrofuro[3,4-b]pyridin-5-one; 3-diethylamino-7,8-benzofluoran; 3,3-bis(1-ethyl-2-methylindol-3-yl)phthalide; 3,3-bis(1-octyl-2-methylindol-3-yl)phthalide; 3-diethylamino-7-anilinofluoran; 3-diethylamino-7-benzylaminofluoran; 3'-phenyl-7-dibenzylamino-2,2'-spiro-di[2H-1-benzopyran]; and mixtures of any two or more of the above.

The coating of the second support comprises color developer material and microcapsules containing a liquid solvent for the color former material coated on the first support. The coating of the second support additionally preferably contains protective stilt material such as uncooked starch particles as disclosed in U.S. application Ser. No. 806,696, filed Mar. 12, 1969, and a divisional U.S. application based thereon, Ser. No. 857,348, filed December, 1977.

When the color former employed in the coating of the first support of the present invention is a basic chromogenic material, then acidic developer material may be employed in the coating of the second support, such as, for example, clays; treated clays (U.S. Pat. Nos. 3,622,364 and 3,753,761); aromatic carboxylic acids such as salicyclic acid; derivatives of aromatic carboxylic acids and metal salts thereof (U.S. Pat. No. 4,022,936); phenolic developers (U.S. Pat. Nos. 3,244,550 and 4,573,063); acidic polymeric material such as phenol-formaldehyde polymers, etc. (U.S. Pat. Nos. 3,455,721 and 3,672,935); and metal-modified phenolic resins (U.S. Pat. Nos. 3,732,120; 3,737,410; 4,165,102; 4,165,103; 4,166,644 and 4,188,456).

The microcapsules for use in the coating of the second support can be prepared by processes well known in the art such as from gelatin as disclosed in U.S. Pat. Nos. 2,800,457 and 3,041,289; or, more preferably, from urea-formaldehyde resin and/or melamine-formaldehyde resin as disclosed in U.S. Pat. Nos. 4,001,140; 4,081,376; 4,089,802; 4,100,103; 4,105,823; 4,444,699; or 4,552,811.

The liquid solvent employed in the microcapsules of the second support can be any material which has sufficient solubility for the color former material, which is liquid within the temperature range at which carbonless copy paper is normally used and which does not suppress or otherwise adversely affect the color-forming reaction. Examples of eligible liquids include, but are not limited to, those solvents conventionally used for carbonless copy paper, including ethyldiphenylmethane (U.S. Pat. No. 3,996,405); benzyxylenes (U.S. Pat. No. 4,130,299); alkyl biphenyls such as propylbiphenyl (U.S. Pat. Nos. 3,627,581) and butylbiphenyl (U.S. Pat. No. 4,287,074); dialkyl phthalates in which the alkyl groups thereof have from 4 to 13 carbon atoms, e.g. dibutyl phthalate, dioctylphthalate, dinonyl phthalate and ditridecylphthalate; 2,2,4-trimethyl-1,3-pentanediol diisobutyrate (U.S. Pat. No. 4,027,065); $C_{10}$–$C_{14}$ alkyl benzenes such as dodecyl benzene; alkyl or aralkyl benzoates such as benzyl benzoate; alkylated naphthalenes such as dipropylnaphthalene (U.S. Pat. No. 3,806,463); partially hydrogenated terphenyls; high-boiling straight or branched chain hydrocarbons; and mixtures of the above.

The coating of the second support can be applied by any appropriate means, particularly those nomally used for coating CB sheets since the coating of the second support has several features in common with a CB sheet.

The following examples are given merely as illustrative of the present invention and are not to be considered as limiting. All percentages and parts throughout the application are by weight unless otherwise specified.

In the examples illustrating the coating of the first support of the present invention, a dispersion of the chromogenic material was prepared by milling the material in an aqueous solution of binder until a particle size of about five microns or less was obtained. The milling was accomplished in a small media mill. The following components and relative amounts were used for the dispersions:

| Component | Parts, Dry |
|---|---|
| Dispersion 1 | |
| crystal violet lactone (CVL) | 84.4 |
| polyvinyl alcohol | 14.4 |
| di-tertiaryacetylene glycol | 1.0 |
| sulfonated castor oil | 0.2 |
| Dispersion 2 | |
| 3,3-bis(1-octyl-2-methylindol-3-yl)phthalide (also called 16-B) | 92.5 |
| polyvinyl alcohol | 6.7 |
| di-tertiary acetylene glycol | 0.6 |
| sulfonated castor oil | 0.2 |

The dispersions were prepared in water. The total solids were 28.7% for Dispersion 1 and 28.5% for Dispersion 2. The dispersions were applied to 72 gsm paper with an A. B. Dick 360 sheet fed offset duplicator using the aqueous dampening (fountain) system on the press. The following Examples were produced:

| Example No. | Dispersion | Color Former Coat Weight, gsm |
|---|---|---|
| 1A | 1 | 0.081 |
| 1B | 1 | 0.143 |
| 1C | 1 | 0.151 |
| 2 | 2 | 0.120 |

A liquid solvent consisting of sec-butylbiphenyl was microencapsulated according to the procedure of U.S. Pat. No. 4,100,103, producing what will be referred to as capsule batch 1.

Capsule batch 1 was mixed with a corn starch binder, uncooked wheat starch particles and water. The mixture was adjusted to pH 7–7.5 with aqueous ammonia and acid-treated montmorillonite clay and styrene-butadiene latex binder were added. The following amounts were utilized.

| Example 3 | |
|---|---|
| Component | Parts, Wet |
| microcapsule slurry 1 (50% solids) | 40.0 |
| wheat starch | 5.0 |
| corn starch binder (10% solids) | 20.0 |
| water | 70.0 |
| clay | 18.0 |
| latex binder (50% solids) | 13.5 |

Three more examples were prepared similar to Example 3, except that a zinc-modified para-octylphenol-formaldehyde resin dispersion, as disclosed in U.S. Pat. No. 4,165,103, was used in addition to or instead of the clay of Example 3.

| | Parts, Wet | | |
|---|---|---|---|
| Component | Example 4 | Example 5 | Example 6 |
| microcapsule slurry 1 (50% solids) | 40.0 | 40.0 | 36.0 |
| wheat starch | 5.0 | 5.0 | 5.0 |
| corn starch binder (10% solids) | 20.0 | 20.0 | 20.0 |

-continued

| | Parts, Wet | | |
|---|---|---|---|
| Component | Example 4 | Example 5 | Example 6 |
| water | 70.0 | 70.0 | 69.0 |
| clay | 18.0 | 18.0 | — |
| resin dispersion (54% solids) | 5.0 | 10.0 | 10.0 |
| latex (50% solids) | 13.5 | 13.5 | 5.0 |

The coating mixtures of Examples 3, 4, 5, and 6 were each applied to a 51 gsm paper substrate with a #12 wire-wound coating rod and the coating was dried using hot air.

For purposes of further discussion, the coated sheets of Examples 1 and 2 will be referred to as the CB sheets and the coated sheets of Examples 3, 4, 5, and 6 will be referred to as the CF sheets. When the CB sheets were placed in coated-side-to-coated-side contact with the CF sheets and pressure applied to the uncoated side of the CB sheets, a readily legible image was produced on the CF sheet and substantially no image was produced on the coated surface of the CB sheet.

To further demonstrate the utility of these coatings, various combinations of CB and CF sheets were prepared and the resulting couplets were imaged in a Typewriter Intensity (TI) test.

In the TI test a standard pattern is typed on a CB-CF couplet. The reflectance of the typed area is a measure of color development on the CF sheet and is reported as the ratio of the reflectance of the typed area to that of the background reflectance of the CF paper (I/Io), expressed as a percentage. A high value indicates little color development and a low value indicates good color development.

Listed in Tables 1 and 2 are the TI date for the CB and CF couplets listed, measured at 20 minutes after typing.

TABLE 1

| | 20 Minute TI | | |
|---|---|---|---|
| CB | Example 3 | Example 4 | Example 5 |
| Example 1A | 69 | 59 | 45 |
| Example 1C | 65 | 50 | 46 |
| Example 2 | 66 | 69 | 63 |

TABLE 2

| | 20 Minute TI | |
|---|---|---|
| CB | Example 3 | Example 6 |
| Example 1A | 69 | 55 |

A liquid solvent consisting of sec-butylbiphenyl was microencapsulated according to the procedure of U.S. Pat. No. 4,552,811, producing what will be referred to as capsule batch 2.

Capsule batch 2 was mixed with acid-treated montmorillonite clay, uncooked wheat starch particles, a corn starch binder, a styrene-butadiene latex binder and water.

| Example 7 | |
|---|---|
| Component | Parts, Wet |
| microcapsule slurry 2 (54% solids) | 55.6 |
| clay | 29.2 |
| wheat starch | 6.6 |
| latex binder (50% solids) | 12.0 |
| corn starch binder (30% solids) | 5.0 |

-continued

| Example 7 | |
|---|---|
| Component | Parts, Wet |
| water | 111.6 |

The mixture of Example 7 was applied to a 51 gsm paper substrate at a dried weight of 8.7 gsm using a pilot plant coater with an air knife coating station.

Dispersions 1 and 2 were each applied to paper and to the uncoated side of Example 7 using a Schriber 500 web offset press with a Dahlgren dampening system. The Examples listed in Table 3 were produced with corresponding coat weight of color former in gsm as listed.

TABLE 3

| Designation | Substrate | Dis-persion | Color Former | Color Former Coat Weight |
|---|---|---|---|---|
| Example 8 | 50 gsm paper | 1 | CVL | 0.414 |
| Example 9 | uncoated side of Example 7 | 1 | CVL | 0.414 |
| Example 10 | 50 gsm paper | 2 | I6-B | 0.236 |
| Example 11 | uncoated side of Example 7 | 2 | I6-B | 0.296 |

According to the terminology previously described, supra, Examples 8 and 10 would be described as CB sheets, Examples 9 and 11 would be described as CFB sheets and Example 7 would be described as CF sheet.

Listed in Table 4 are the TI data for various CB surfaces tested against Example 7 as the CF surface.

TABLE 4

| CB Surface | 20 Minute TI |
|---|---|
| Example 8 | 60 |
| Example 9 | 56 |
| Example 10 | 60 |
| Example 11 | 65 |

For comparison purposes, two additional samples, not within the scope of the claimed invention, were prepared. A coating mixture was prepared according to the components and the relative amounts listed below.

| Example 12 | |
|---|---|
| Component | Parts, Dry |
| microcapsule slurry 2 (54% solids) | 55.6 |
| wheat starch | 6.6 |
| corn starch binder (30% solids) | 4.0 |
| styrene-butadiene latex binder (50% solids) | 6.0 |
| water | 71.4 |

The mixture of Example 12 was applied to a 50 gsm paper substrate at a dried coat weight of 5.0 gsm using a pilot plant coater with an air knife coating station.

Dispersions 1 and 2 were each applied to the coated side of Example 12 using a Schriber 500 web offset press with a Dahlgren dampening system.

The Examples listed in Table 5 were produced with corresponding coat weight of color former in gsm as listed.

TABLE 5

| Designation | Substrate | Dis-persion | Color Former | Color Former Coat Weight |
|---|---|---|---|---|
| Example 13 | coated side of Example 12 | 1 | CVL | 0.414 |

TABLE 5-continued

| Designation | Substrate | Dis-persion | Color Former | Color Former Coat Weight |
|---|---|---|---|---|
| Example 14 | coated side of Example 12 | 2 | I6-B | 0.251 |

The resulting Examples 13 and 14 were coupled with a CF sheet comprising a zinc-modified phenolic resin as disclosed in U.S. Pat. Nos. 3,732,120 and 3,737,410. Examples 13 and 14 are CB sheets in the more conventional sense where the microcapsules reside on the underside of the top sheet. The application of pressure to the top sheet ruptures the capsules in the area of applied pressure to the top sheet ruptures the capsules in the area of applied pressure and transfers the liquid solvent to the underlying CF sheet. Listed in Table 6 are the TI data for the couplets of CB Examples 13 and 14 with the CF sheet as described.

TABLE 6

| CB Surface | 20 Minute TI |
|---|---|
| Example 13 | 71 |
| Example 14 | 80 |

Thus, the combination of Example 13 and a CF sheet with the above-described composition and the combination of Examples 1A and Example 6 each have the same components but in different arrangements. Even though the combination of the present invention (Example 1A and 6) has a drastically reduced amount of color former compared to the control combination, it produces a substantially greater image intensity.

The CB sheets of the present invention (Examples 1, 2, 8, 9, 10 and 11) can be prepared from either aqueous dispersions or organic liquid dispersion.

A 25% by weight dispersion of CVL in mineral oil was prepared by ball milling to a particle size of about 10 microns or less. This dispersion was applied to a paper substrate using an INSTITUUT voor GRAFISCHE TECHNIEK (IGT) Model A2 printability tester in a simulated printing operation. This printed sheet was designated Example 15. When Example 15 was placed in coated-side-to-coated-side contact with Example 3 and pressure applied to the uncoated side of Example 15, a readily legible image was produced on the coated surface of Example 3 and substantially no image was produced on the coated surface of Example 15.

The invention being thus described, it will be obvious that the same may be varied in many ways. Such variations are not to be regarded as a departure from the spirit and scope of the invention and all such modifications are intended to be included within the scope of the following claims.

What is claimed is:

1. A pressure-sensitive record unit comprising a first support having bound on the surface thereof a coating comprising solid color former material and a second support having bound on the surface thereof, in contiguous juxtaposition with the coating of the first support, a coating comprising solid color developer material and microcapsules containing a liquid solvent for the color former.

2. The record unit of claim 1 wherein the color former material is basic chromogenic material.

3. The record unit of claim 2 wherein the color former material is selected from the group consisting of crystal violet lactone, 3-diethylamino-6-methyl-7-anilinofluoran; 3-diethylamino-6-methyl-7-(2',4'-dimethylanilino)-fluoran; 7-(1-ethyl-2-methylindol-3-yl)-7-(4-diethylamino-2-ethoxyphenyl)-5,7-dihydrofuro[3,4-b]pyridin-5-one; 7-(1-octyl-2-methylindol-3-yl)-7-(4-diethylamino-2-ethoxyphenyl)-5,7-dihydrofuro[3,4-b]pyridin-5-one; and 3,3-bis(1-octyl-2-methylindol-3-yl)phthalide.

4. The record unit of claim 3 wherein the color former material is crystal violet lactone.

5. The record unit of claim 2 wherein the color developer material is selected from the group consisting of treated clays, derivatives of aromatic carboxylic acids and metal salts thereof, phenol-formaldehyde polymers and metal-modified phenolic resin.

6. The record unit of claim 5 wherein the color developer material is selected from the group consisting of phenol-formaldehyde polymers and metal-modified phenolic resins.

7. The record unit of claim 6 wherein the color developer material is a metal-modified phenolic resin.

8. The record unit of claims 1, 2 or 5 wherein the liquid solvent for the color former is selected from the group consisting of ethyldiphenylmethane, benzylxylenes and alkyl biphenyls.

9. The record unit of claim 8 wherein the liquid solvent for the color former is selected from the group consisting of propylbiphenyl and butylbiphenyl.

10. The record unit of claim 9 wherein the liquid solvent for the color former is butylbiphenyl.

11. The record unit of claim 8 wherein the coating comprising solid color developer material and microcapsules further comprises a particulate starch material.

12. The record unit of claim 11 wherein the particulate starch material is wheat starch.

13. The record unit of claim 8 wherein the first support and the second support are paper.

* * * * *